US005508724A

United States Patent [19]

Boyd et al.

[11] Patent Number: 5,508,724

[45] Date of Patent: Apr. 16, 1996

[54] PASSIVE MULTIPLEXING USING SPARSE ARRAYS

[75] Inventors: Melissa D. Boyd; Daniel A. Kearl, both of Corvallis, Oreg.

[73] Assignee: Hewlett-Packard Company, Palo Alto, Calif.

[21] Appl. No.: 118,371

[22] Filed: Sep. 7, 1993

[51] Int. Cl.[6] ..... B41J 2/01

[52] U.S. Cl. ..... 347/58; 347/180

[58] Field of Search ..... 347/58, 50, 12, 347/57, 180; 340/825.79

[56] References Cited

U.S. PATENT DOCUMENTS

| | | | |
|---|---|---|---|
| 4,360,818 | 11/1982 | Moriguchi et al. | 346/76 |
| 4,633,228 | 12/1986 | Larson | 340/365 |
| 5,144,336 | 9/1992 | Yeung | 346/140 R |

FOREIGN PATENT DOCUMENTS

| | | | |
|---|---|---|---|
| 0359669 | 3/1990 | European Pat. Off. | H03M 11/00 |
| 3633563 | 4/1988 | Germany | G06F 3/02 |
| 2031805 | 4/1980 | United Kingdom | B41J 3/20 |

*Primary Examiner*—Benjamin R. Fuller
*Assistant Examiner*—Craig A. Hallacher

[57] ABSTRACT

A multiplexed array of resistors including a plurality of address leads and a plurality of ground leads which cooperatively define a matrix of nodes, each node defining a possible location in the matrix for a resistor heater interconnecting one address lead and one ground lead. Resistor heaters are located in the array at only a portion of the nodes. The locations of the resistor heaters are selected to limit the conductance of alternate current paths around the resistor heater when addressed. The resistor heaters are preferably formed at nodes selected so that no two address leads are interconnected through resistor heaters to more than one common ground lead. Preferably, each alternate current path includes at least four non-addressed resistors in series.

10 Claims, 5 Drawing Sheets

| ADDRESS LEAD | GROUND LEAD 1 | 2 | 3 | 4 | 5 | 6 | 7 | 8 | 9 | 10 |
|---|---|---|---|---|---|---|---|---|---|---|
| 1 | R | R | • | • | • | • | • | • | • | • |
| 2 | R | • | R | • | • | • | • | • | • | • |
| 3 | R | • | • | R | • | • | • | • | • | • |
| 4 | R | • | • | • | R | • | • | • | • | • |
| 5 | R | • | • | • | • | R | • | • | • | • |
| 6 | R | • | • | • | • | • | R | • | • | • |
| 7 | R | • | • | • | • | • | • | R | • | • |
| 8 | R | • | • | • | • | • | • | • | R | • |
| 9 | R | • | • | • | • | • | • | • | • | R |
| 10 | • | R | R | • | • | • | • | • | • | • |
| 11 | • | R | • | R | • | • | • | • | • | • |
| 12 | • | R | • | • | R | • | • | • | • | • |
| 13 | • | R | • | • | • | R | • | • | • | • |
| 14 | • | R | • | • | • | • | R | • | • | • |
| 15 | • | R | • | • | • | • | • | R | • | • |
| 16 | • | R | • | • | • | • | • | • | R | • |
| 17 | • | R | • | • | • | • | • | • | • | R |
| 18 | • | • | R | R | • | • | • | • | • | • |
| 19 | • | • | R | • | R | • | • | • | • | • |
| 20 | • | • | R | • | • | R | • | • | • | • |
| 21 | • | • | R | • | • | • | R | • | • | • |
| 22 | • | • | R | • | • | • | • | R | • | • |
| 23 | • | • | R | • | • | • | • | • | R | • |
| 24 | • | • | R | • | • | • | • | • | • | R |
| 25 | • | • | • | R | R | • | • | • | • | • |
| 26 | • | • | • | R | • | R | • | • | • | • |
| 27 | • | • | • | R | • | • | R | • | • | • |
| 28 | • | • | • | R | • | • | • | R | • | • |
| 29 | • | • | • | R | • | • | • | • | R | • |
| 30 | • | • | • | R | • | • | • | • | • | R |
| 31 | • | • | • | • | R | R | • | • | • | • |
| 32 | • | • | • | • | R | • | R | • | • | • |
| 33 | • | • | • | • | R | • | • | R | • | • |
| 34 | • | • | • | • | R | • | • | • | R | • |
| 35 | • | • | • | • | R | • | • | • | • | R |
| 36 | • | • | • | • | • | R | R | • | • | • |
| 37 | • | • | • | • | • | R | • | R | • | • |
| 38 | • | • | • | • | • | R | • | • | R | • |
| 39 | • | • | • | • | • | R | • | • | • | R |
| 40 | • | • | • | • | • | • | R | R | • | • |
| 41 | • | • | • | • | • | • | R | • | R | • |
| 42 | • | • | • | • | • | • | R | • | • | R |
| 43 | • | • | • | • | • | • | • | R | R | • |
| 44 | • | • | • | • | • | • | • | R | • | R |
| 45 | • | • | • | • | • | • | • | • | R | R |

30

10 12

| ADDRESS LEAD | GROUND LEAD 1 | 2 | 3 | 4 |
|---|---|---|---|---|
| 1 | R | • | • | • |
| 2 | R | • | • | • |
| 3 | R | • | • | • |
| 4 | R | • | • | • |
| 5 | R | • | • | • |
| 6 | R | • | • | • |
| 7 | R | • | • | • |
| 8 | R | • | • | • |
| 9 | R | • | • | • |
| 10 | R | • | • | • |
| 11 | R | • | • | • |
| 12 | R | • | • | • |
| 13 | • | R | • | • |
| 14 | • | R | • | • |
| 15 | • | R | • | • |
| 16 | • | R | • | • |
| 17 | • | R | • | • |
| 18 | • | R | • | • |
| 19 | • | R | • | • |
| 20 | • | R | • | • |
| 21 | • | R | • | • |
| 22 | • | R | • | • |
| 23 | • | R | • | • |
| 24 | • | R | • | • |
| 25 | • | • | R | • |
| 26 | • | • | R | • |
| 27 | • | • | R | • |
| 28 | • | • | R | • |
| 29 | • | • | R | • |
| 30 | • | • | R | • |
| 31 | • | • | R | • |
| 32 | • | • | R | • |
| 33 | • | • | R | • |
| 34 | • | • | R | • |
| 35 | • | • | R | • |
| 36 | • | • | R | • |
| 37 | • | • | R | • |
| 38 | • | • | • | R |
| 39 | • | • | • | R |
| 40 | • | • | • | R |
| 41 | • | • | • | R |
| 42 | • | • | • | R |
| 43 | • | • | • | R |
| 44 | • | • | • | R |
| 45 | • | • | • | R |
| 46 | • | • | • | R |
| 47 | • | • | • | R |
| 48 | • | • | • | R |
| 49 | • | • | • | R |
| 50 | • | • | • | R |

Fig. 1

—PRIOR ART—

30

| ADDRESS LEAD | GROUND LEAD 1 | 2 | 3 | 4 | 5 | 6 | 7 | 8 | 9 | 10 |
|---|---|---|---|---|---|---|---|---|---|---|
| 1 | R | R | • | • | • | • | • | • | • | • |
| 2 | R | • | R | • | • | • | • | • | • | • |
| 3 | R | • | • | R | • | • | • | • | • | • |
| 4 | R | • | • | • | R | • | • | • | • | • |
| 5 | R | • | • | • | • | R | • | • | • | • |
| 6 | R | • | • | • | • | • | R | • | • | • |
| 7 | R | • | • | • | • | • | • | R | • | • |
| 8 | R | • | • | • | • | • | • | • | R | • |
| 9 | R | • | • | • | • | • | • | • | • | R |
| 10 | • | R | R | • | • | • | • | • | • | • |
| 11 | • | R | • | R | • | • | • | • | • | • |
| 12 | • | R | • | • | R | • | • | • | • | • |
| 13 | • | R | • | • | • | R | • | • | • | • |
| 14 | • | R | • | • | • | • | R | • | • | • |
| 15 | • | R | • | • | • | • | • | R | • | • |
| 16 | • | R | • | • | • | • | • | • | R | • |
| 17 | • | R | • | • | • | • | • | • | • | R |
| 18 | • | • | R | R | • | • | • | • | • | • |
| 19 | • | • | R | • | R | • | • | • | • | • |
| 20 | • | • | R | • | • | R | • | • | • | • |
| 21 | • | • | R | • | • | • | R | • | • | • |
| 22 | • | • | R | • | • | • | • | R | • | • |
| 23 | • | • | R | • | • | • | • | • | R | • |
| 24 | • | • | R | • | • | • | • | • | • | R |
| 25 | • | • | • | R | R | • | • | • | • | • |
| 26 | • | • | • | R | • | R | • | • | • | • |
| 27 | • | • | • | R | • | • | R | • | • | • |
| 28 | • | • | • | R | • | • | • | R | • | • |
| 29 | • | • | • | R | • | • | • | • | R | • |
| 30 | • | • | • | R | • | • | • | • | • | R |
| 31 | • | • | • | • | R | R | • | • | • | • |
| 32 | • | • | • | • | R | • | R | • | • | • |
| 33 | • | • | • | • | R | • | • | R | • | • |
| 34 | • | • | • | • | R | • | • | • | R | • |
| 35 | • | • | • | • | R | • | • | • | • | R |
| 36 | • | • | • | • | • | R | R | • | • | • |
| 37 | • | • | • | • | • | R | • | R | • | • |
| 38 | • | • | • | • | • | R | • | • | R | • |
| 39 | • | • | • | • | • | R | • | • | • | R |
| 40 | • | • | • | • | • | • | R | R | • | • |
| 41 | • | • | • | • | • | • | R | • | R | • |
| 42 | • | • | • | • | • | • | R | • | • | R |
| 43 | • | • | • | • | • | • | • | R | R | • |
| 44 | • | • | • | • | • | • | • | R | • | R |
| 45 | • | • | • | • | • | • | • | • | R | R |

Fig.3

| ADDRESS LEAD | GROUND LEAD | | | | | | | | | | | | | | | | | | | | | | | | | | |
|---|---|---|---|---|---|---|---|---|---|---|---|---|---|---|---|---|---|---|---|---|---|---|---|---|---|---|---|
| | | | | | | | | | | 1 | | | | | | | | | | 2 | | | | | | | |
| | 1 | 2 | 3 | 4 | 5 | 6 | 7 | 8 | 9 | 0 | 1 | 2 | 3 | 4 | 5 | 6 | 7 | 8 | 9 | 0 | 1 | 2 | 3 | 4 | 5 | 6 | 7 |
| 1 | R | R | R | R | • | • | • | • | • | • | • | • | • | • | • | • | • | • | • | • | • | • | • | • | • | • | • |
| 2 | • | • | • | R | R | R | R | • | • | • | • | • | • | • | • | • | • | • | • | • | • | • | • | • | • | • | • |
| 3 | • | • | • | • | • | • | R | R | R | R | • | • | • | • | • | • | • | • | • | • | • | • | • | • | • | • | • |
| 4 | • | • | • | • | • | • | • | • | • | R | R | R | R | • | • | • | • | • | • | • | • | • | • | • | • | • | • |
| 5 | • | • | • | • | • | • | • | • | • | • | • | • | R | R | R | R | • | • | • | • | • | • | • | • | • | • | • |
| 6 | • | • | • | • | • | • | • | • | • | • | • | • | • | • | • | R | R | R | R | • | • | • | • | • | • | • | • |
| 7 | • | • | • | • | • | • | • | • | • | • | • | • | • | • | • | • | • | • | R | R | R | R | • | • | • | • | • |
| 8 | • | • | • | • | • | • | • | • | • | • | • | • | • | • | • | • | • | • | • | • | • | R | R | R | R | • | • |
| 9 | R | • | • | • | • | • | • | • | • | • | • | • | • | • | • | • | • | • | • | • | • | • | • | • | R | R | R |
| 10 | R | • | • | • | • | • | • | R | • | • | • | • | • | R | • | • | • | • | • | • | R | • | • | • | • | • | • |
| 11 | R | • | • | • | • | • | • | • | R | • | • | • | • | • | R | • | • | • | • | R | • | • | • | • | • | • | • |
| 12 | • | R | • | • | • | • | • | R | • | • | • | • | • | • | • | R | • | • | • | • | • | • | R | • | • | • | • |
| 13 | • | R | • | • | • | • | • | • | R | • | • | • | • | R | • | • | • | • | • | • | • | R | • | • | • | • | • |
| 14 | • | R | • | • | • | • | • | • | • | R | • | • | • | • | • | • | R | • | • | • | • | • | • | R | • | • | • |
| 15 | • | • | R | • | • | • | • | R | • | • | • | • | • | • | R | • | • | • | • | • | • | R | • | • | • | • | • |
| 16 | • | • | R | • | • | • | • | • | R | • | • | • | • | • | • | R | • | • | • | • | • | • | • | R | • | • | • |
| 17 | • | • | R | • | • | • | • | • | • | R | • | • | • | • | • | • | • | R | • | • | • | • | R | • | • | • | • |
| 18 | • | • | • | R | • | • | • | • | • | • | R | • | • | • | • | • | R | • | • | • | • | • | R | • | • | • | • |
| 19 | • | • | • | R | • | • | • | • | • | • | • | R | • | • | • | • | • | R | • | • | • | • | • | R | • | • | • |
| 20 | • | • | • | • | R | • | • | • | • | • | R | • | • | • | • | • | • | R | • | • | • | • | • | • | R | • | • |
| 21 | • | • | • | • | R | • | • | • | • | • | • | R | • | • | • | • | • | • | R | • | • | • | • | • | • | R | • |
| 22 | • | • | • | • | R | • | • | • | • | • | • | • | R | • | • | • | • | • | • | R | • | • | • | • | • | • | R |
| 23 | • | • | • | • | • | R | • | • | • | • | R | • | • | • | • | • | • | • | R | • | • | • | • | • | • | • | R |
| 24 | • | • | • | • | • | R | • | • | • | • | • | R | • | • | • | • | R | • | • | • | • | • | • | • | R | • | • |
| 25 | • | • | • | • | • | R | • | • | • | • | • | • | R | • | • | • | • | • | • | • | R | • | • | • | • | R | • |
| 26 | • | • | • | • | • | • | R | • | • | • | • | • | • | R | • | • | • | • | • | R | • | • | • | • | • | R | • |
| 27 | • | • | • | • | • | • | R | • | • | • | • | • | • | • | R | • | • | • | • | • | R | • | • | • | • | • | R |

Fig.4

| ADDRESS LEAD | GROUND LEAD | | | | | | | | | | | | | | | | | | | | | | | | |
|---|---|---|---|---|---|---|---|---|---|---|---|---|---|---|---|---|---|---|---|---|---|---|---|---|---|
| | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 | 24 | 25 | 26 |
| 1 | R | R | R | R | • | • | • | • | • | • | • | • | • | • | • | • | • | • | • | • | • | • | • | • | • | • |
| 2 | • | • | • | R | R | R | R | • | • | • | • | • | • | • | • | • | • | • | • | • | • | • | • | • | • | • |
| 3 | • | • | • | • | • | • | R | R | R | R | • | • | • | • | • | • | • | • | • | • | • | • | • | • | • | • |
| 4 | • | • | • | • | • | • | • | • | • | R | R | R | R | • | • | • | • | • | • | • | • | • | • | • | • | • |
| 5 | R | • | • | • | R | • | • | R | • | • | R | • | • | • | • | • | • | • | • | • | • | • | • | • | • | • |
| 6 | R | • | • | • | • | R | • | • | R | • | • | R | • | • | • | • | • | • | • | • | • | • | • | • | • | • |
| 7 | R | • | • | • | • | • | R | • | • | • | • | • | R | • | • | • | • | • | • | • | • | • | • | • | • | • |
| 8 | • | R | • | • | R | • | • | • | R | • | • | • | R | • | • | • | • | • | • | • | • | • | • | • | • | • |
| 9 | • | R | • | • | • | R | • | • | • | R | • | • | • | • | • | • | • | • | • | • | • | • | • | • | • | • |
| 10 | • | R | • | • | • | • | R | • | • | • | R | • | • | • | • | • | • | • | • | • | • | • | • | • | • | • |
| 11 | • | • | R | • | R | • | • | • | • | • | • | • | • | • | • | • | • | • | • | • | • | • | • | • | • | • |
| 12 | • | • | R | • | • | R | • | • | • | • | R | • | • | • | • | • | • | • | • | • | • | • | • | • | • | • |
| 13 | • | • | R | • | • | • | • | R | • | • | • | R | • | • | • | • | • | • | • | • | • | • | • | • | • | • |
| 14 | • | • | • | R | • | • | • | R | • | • | • | • | R | • | • | • | • | • | • | • | • | • | • | • | • | • |
| 15 | • | • | • | R | • | • | • | • | • | R | • | R | • | • | • | • | • | • | • | • | • | • | • | • | • | • |
| 16 | • | • | • | • | • | • | • | • | • | • | • | • | • | R | R | R | R | • | • | • | • | • | • | • | • | • |
| 17 | • | • | • | • | • | • | • | • | • | • | • | • | • | • | • | • | R | R | R | R | • | • | • | • | • | • |
| 18 | • | • | • | • | • | • | • | • | • | • | • | • | • | • | • | • | • | • | • | R | R | R | R | • | • | • |
| 19 | • | • | • | • | • | • | • | • | • | • | • | • | • | • | • | • | • | • | • | • | • | • | R | R | R | R |
| 20 | • | • | • | • | • | • | • | • | • | • | • | • | • | R | • | • | • | R | • | • | R | • | • | R | • | • |
| 21 | • | • | • | • | • | • | • | • | • | • | • | • | • | R | • | • | • | • | R | • | • | R | • | • | R | • |
| 22 | • | • | • | • | • | • | • | • | • | • | • | • | • | R | • | • | • | • | • | R | • | • | • | • | • | R |
| 23 | • | • | • | • | • | • | • | • | • | • | • | • | • | • | R | • | • | R | • | • | • | R | • | • | • | R |
| 24 | • | • | • | • | • | • | • | • | • | • | • | • | • | • | R | • | • | • | R | • | • | • | R | • | • | • |
| 25 | • | • | • | • | • | • | • | • | • | • | • | • | • | • | R | • | • | • | • | R | • | • | • | R | • | • |
| 26 | • | • | • | • | • | • | • | • | • | • | • | • | • | • | • | R | • | R | • | • | • | • | • | • | • | • |
| 27 | • | • | • | • | • | • | • | • | • | • | • | • | • | • | • | R | • | • | R | • | • | • | • | R | • | • |
| 28 | • | • | • | • | • | • | • | • | • | • | • | • | • | • | • | R | • | • | • | • | R | • | • | • | R | • |
| 29 | • | • | • | • | • | • | • | • | • | • | • | • | • | • | • | • | R | • | • | • | R | • | • | • | • | R |
| 30 | • | • | • | • | • | • | • | • | • | • | • | • | • | • | • | • | R | • | • | • | • | • | R | • | R | • |

Fig.6

PASSIVE MULTIPLEXING USING SPARSE ARRAYS

BACKGROUND OF THE INVENTION

This invention relates generally to an apparatus and method for multiplexing an array of resistor heaters in a thermal inkjet printhead, and more particularly to an apparatus and method for multiplexing an array of resistor heaters to form a sparse array for limiting current flowing to non-addressed resistors.

Thermal ink jet printers and are well-known in the an, as described in U.S. Pat. Nos. 4,490,728, and 4,313,684. A thermal ink jet printer includes an array of printing cells formed on a printing head, which in turn is mounted on a replaceable, disposable housing having one or more ink reservoirs. In the following discussion, an array of resistor heaters will be portrayed schematically as a rectilinear matrix made up of rows and columns of resistor heaters. Each printing cell includes a small ink reservoir, a printing nozzle, and an electrically driven resistor heater formed opposite the printing nozzle. The resistor heater of each cell is connected to a current source by an address lead and a ground lead. The printing cells and required electrical leads are typically formed on a silicon substrate by known photolithographic deposition, metallization and etching techniques. In operation, the printing cell is fired by switching one or both of the address and ground leads to direct a current through the resistor heater. The heat generated by the current in the addressed resistor heater vaporizes a portion of the ink in the reservoir, ejecting a drop of ink through the printing nozzle onto a medium such as a sheet of paper.

The performance and print quality of a thermal ink jet printhead can be enhanced by increased the printing cell density on the printhead. Printing cell density on the printhead is limited in part by the space occupied by conductive leads which electrically connect the array of printing cells to the control circuitry of the printer. Printing cell density could therefore be increased if fewer conductive leads were required to electrically connect the array.

FIG. 1 depicts one known arrangement for reducing the number of conductive leads in which each resistor heater is connected to a separate address lead 10, while each ground lead 12 is connected to multiple resistor heaters R. This arrangement requires 54 leads for 50 resistor heaters, a relatively high number.

Turning now to FIG. 2, a fully multiplexed array, shown generally at 20, requires the fewest number of leads. A fully multiplexed array is one in which all the resistor heaters 22 in each row are connected to a single address lead 24, and all the resistor heaters in a given column are connected to a single ground lead 26. In this way, the total number of leads required for an array of any given size can be reduced to a minimum. For example, only 10 address leads and 10 ground leads are required for a fully multiplexed 10×10 array of 100 resistor heaters. As the aspect ratio of an array varies from unity, the degree of reduction is less, but remains significant. For example, a multiplexed 5×20 array of 100 resistor heaters requires as few as 25 leads, which is still a significant reduction over the 100 or more required in a non-multiplexed array.

Multiplexed arrays suffer from one significant drawback however. Due to the interconnection of address leads and ground leads through multiple resistor heaters, the firing of an addressed resistor heater results in parasitic voltages being impressed upon non-addressed resistor heaters, driving leakage currents through them. In FIG. 2, for example, when resistor heater **22*a*** is fired, parasitic voltages are impressed upon surrounding resistor heaters, driving leakage currents through them.

Leakage currents cause several problems. First, leakage current levels through a particular resistor heater can reach the turn on energy (TOE) of the resistor heater, causing it to misfire. Even if a leakage current does not reach TOE, it will tend to raise the temperature of the unaddressed resistor heater and render precise control of the drop size ejected from the printing cell difficult. Leakage currents also increase the total current flowing through each ground lead, requiting larger and more expensive ground lead switching transistors. Finally leakage currents cumulatively increase the power delivered to the printhead. The increased power levels can raise the printhead temperature and change the size of ink drops ejected from individual printing cells, adversely affecting print quality.

One method for nullifying parasitic voltages in multiplexed arrays includes biasing the ground leads in the array. While effective to control leakage currents, this method requires additional switching to open circuit the ground lead bias voltage when the resistor heater is addressed. The additional switching step requires switches and control elements which add cost and complexity to the printer. Another known method used to nullify parasitic voltages incorporates a transistor interposed between the address line and the supply side of each resistance heater. The turn-on voltage of the transistor is greater than the maximum parasitic voltage, thereby isolating non-addressed resistors from ground. While solving the problem of parasitic voltages and leakage currents, this method also adds significant complexity and expense to the fabrication of the printhead.

Accordingly, a need remains for a cost effective method of multiplexing an array of resistor heaters on a thermal inkjet printhead which effectively controls parasitic voltages and leakage currents in the array.

SUMMARY OF THE INVENTION

The present invention is embodied in a method of forming a multiplexed array of resistor heaters comprising the steps of forming a plurality of address leads and a plurality of ground leads which cooperatively define a plurality of nodes. Each node defines a possible location for a resistor heater interconnecting one address lead and one ground lead. Resistor heaters are formed at a portion of the nodes in the array. The resistor heater locations in the array are selected to limit the conductance of alternate current paths around any resistor heater when addressed. The nodes are preferably selected so that no two address leads in the array are connected through resistor heaters to a common pair of ground leads. The method may include selecting the resistor locations so that any alternate current path includes at least four non-selected resistor heaters in series.

The present invention is also embodied in an array of resistors comprising a plurality of address leads and a plurality of ground leads which cooperatively define a matrix of nodes, each node defining a possible location in the matrix for forming a resistor heater interconnecting one address lead and one ground lead. Resistor heaters are located in the array at only a portion of the nodes, and interconnect an address lead and a ground lead at each selected node. The locations of the resistor heaters are selected to limit the conductance of one or more alternate current paths around a resistor heater when addressed. The resistor heaters are preferably formed at nodes selected so that no two address leads are interconnected through resistor heaters to more than one common ground lead. In one embodiment of an array according to the present invention, each alternate current path includes at least four non-addressed resistors in series.

The present invention is also embodied in a thermal inkjet printhead comprising an array of resistance heaters as just described.

These and other features and advantages of the invention will become more readily apparent from the following detailed description of a preferred embodiment of the invention which proceeds with reference to the accompanying drawings.

BRIEF DESCRIPTION OF THE DRAWINGS

FIG. I is a schematic diagram of a non-multiplexed array of resistance heaters.

FIG. 3 is a schematic representation of a first embodiment of a multiplexed 10×45 array of resistance heaters according to the present invention.

FIG. 4 is a schematic representation of a second embodiment of a multiplexed 27×27 array of resistance heaters according to the present invention.

FIG. 6 is a schematic diagram of a third embodiment of a multiplexed array according to the present invention.

DETAILED DESCRIPTION

Figure 2:
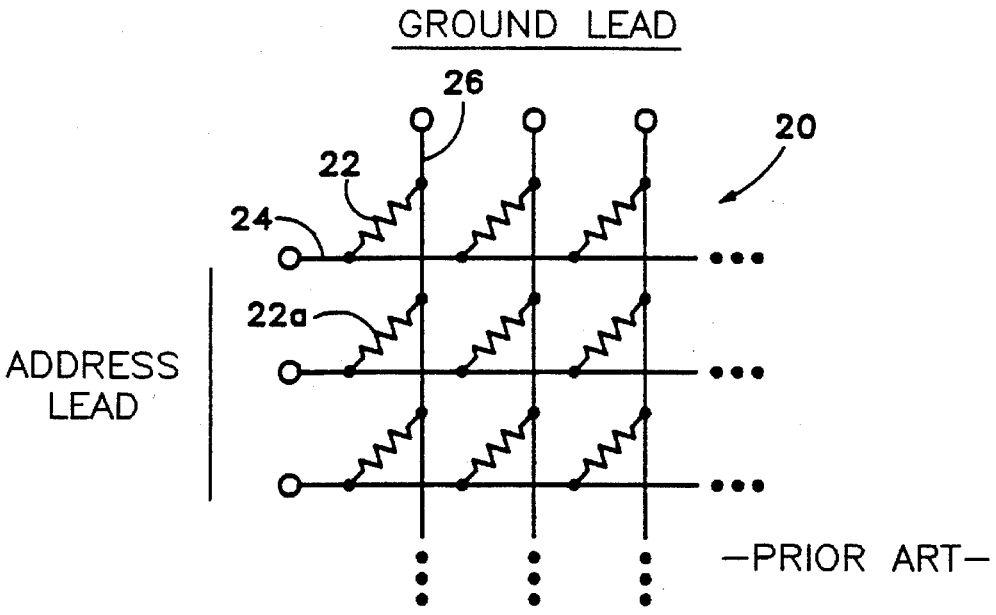
FIG. 2 is a schematic representation of a prior art multiplexed array of resistance heaters.

Turning to the drawings, known resistor heater arrays for thermal printer inkjet printheads are depicted schematically in FIGS. 1 and 2, while two embodiments of the present invention are depicted schematically in FIGS. 3 and 4. In each figure, the location of each resistance heater in the array is designated by "R". Unused nodes in the array are depicted as a dot. The present invention is not intended to be limited in scope to a rectilinear array of straight address and ground leads which is shown in FIGS. 3 and 4, but may be embodied in an array having curved or angular address or ground leads.

Referring now to FIG. 3, a multiplexed array of resistance heaters according to the present invention having 45 address leads and 10 ground leads is shown generally at 30. The address leads are depicted as horizontal rows of resistor heaters (R) and vacant nodes (dots). Similarly, the ground leads are shown as vertical columns of resistor heaters R and vacant nodes (dots). Of the 450 nodes provided in this array, 90 are occupied by resistor heaters R at the specific locations shown. According to the present invention, the resistor heater locations are selected so that no two address leads are interconnected through resistor heaters to a common pair of ground leads.

Applicant has discovered that multiplexing an array according to this method unexpectedly reduces leakage current levels through unaddressed resistor heaters. In contrast to the teachings of the prior art, these leakage currents reductions are achieved without additional switching transistors, and without biasing unaddressed resistor heaters. The leakage currents are reduced by this multiplexing method because at least 4 unaddressed resistor heaters are present in each alternate current path when any resistor heater is fired.

Figure 5:
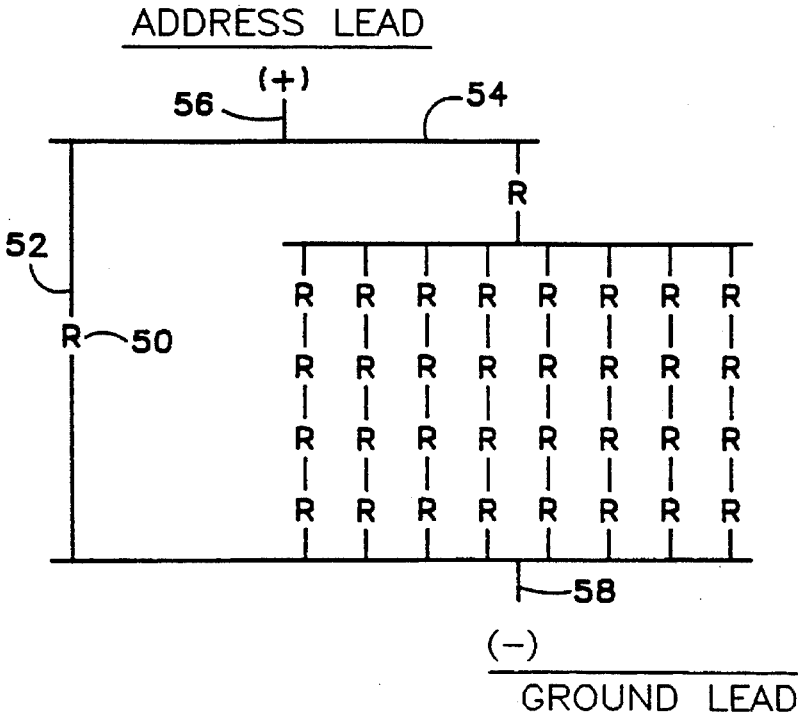
FIG. 5 is a schematic diagram of the array of FIG. 3 showing alternate current paths between a address lead and a ground lead when a resistor is addressed.

The leakage current characteristics of this embodiment are best understood by reference to FIG. 5, a schematic of the current paths defined when a single resistor heater 50 in the array is fired. As before, the maximum number of alternate current paths is greatest when one resistor per ground lead is fired. The overall resistance path is comprised of the resistance of the intended current path 52 through the addressed resistor 50, and the resistance of the alternate current path 54, which includes current leakage paths through all non-addressed resistors which can be easily seen from FIG. 3 by tracing the path from the non-selected resistor connected to selected address lead to resistors of other non-selected address leads sharing the same non-selected ground lead, ultimately returning via resistors sharing the selected ground lead. For the array of FIG. 3 of like resistor heaters R having a resistance Ω, the resistance of the intended current path 52 can be assumed to be approximately Ω. The resistance of the alternate current path 54 was calculated to be 1.5Ω, and the overall resistance from address lead 56 to ground lead 58 to be 0.6Ω. For a given potential V between address lead 56 and ground lead 58, a current of I would be driven through the addressed resistor, and a current of 0.67 I through alternate current path 54, which would also be the maximum current through any non-addressed resistor. Assuming that the total energy delivered to the addressed resistor is 125% of TOE, the energy delivered to the alternate current path is 84% of TOE. The maximum energy delivered to any non-addressed resistor would be 56% of TOE, significantly reducing the likelihood of misfiring. At the same time, the total current through any single ground lead would be limited to about two times the design current of the addressed resistor heater, and the total energy delivered to the printhead through the alternate current path would be about 84% of TOE.

FIG. 4 shows a second embodiment of the present invention in which 27 address leads and 27 ground leads define 729 nodes. Resistor heaters R, each having a resistance Ω, occupy 108 (15%) of the 729 nodes at the locations shown. As in the first embodiment, no pair of address leads are connected through resistance heaters to more than one common ground lead. FIG. 6 schematically depicts the current paths of a simplified model of a square array, such as that of FIG. 4, defined when a heater resistor 60 having a resistance Ω is fired. The resistance of the unintended current path 62 is approximated from FIG. 4 by tracing the leakage path through the unselected resistors sharing the selected address lead and the resistors sharing common unselected ground leads and ultimately returning to the selected ground lead. This unintended path resistance can be calculated from the approximation of FIG. 6 to be 0.93Ω, ground lead 66 to be 0.48Ω. For a given potential V between address lead 64 and ground lead 66 driving a current of I through the intended current path 66, a current of 1.08 I is driven through the alternate current path 62. The maximum current through any non-addressed resistor in the alternate current path is 0.36 I. Assuming again that the total energy delivered to the intended resistor is 125% TOE, the energy delivered to the alternate current path is 136% of TOE, and the maximum energy delivered to any resistor heater in the alternate current path is 16% TOE, effectively precluding misfiring of any resistor heater in the alternate current path. This array was assembled and tested. The test results corresponded well with the calculated current flows.

A comparison of the characteristics of the first and second embodiments of the invention demonstrate how the present invention can be employed to meet specific printhead design criteria. A "square" array as shown in FIG. 4 provides the greatest protection against misfiring of a non-addressed resistor by limiting the energy delivered to any non-addressed resistor to 16% of TOE or less, compared to 56% of TOE for the "rectangular" array of the first embodiment shown in FIG. 3. On the other hand, the rectangular array of FIG. 3 results in lower printhead temperatures by limiting the total energy delivered to the printhead through the alternate path to 84% of TOE, compared to 136% for the square array of FIG. 4. It will be understood by those skilled in the art that other array configurations embodying the present invention would provide other combinations of parameters which may be suitable for particular applications. One such example is shown in FIG. 6.

FIG. 6 is a schematic of a third embodiment of the present invention in which a pair of similar arrays are formed on a printhead. Each array has 15 address leads and 13 commons, defining 180 nodes, and 51 resistor heaters R located as shown. This arrangement has the advantage of dividing the electrical lines into two groups and readily accommodating printhead designs incorporating two parallel rows of resistors on either side of a central ink supply.

FIG. 6 also demonstrates that the present invention is not limited to arrays in which all the commons or all the address leads in the array contain the same number of utilized nodes, although such an arrangement is normally preferable to maintain a constant operating energy.

Having described and illustrated the principles of the invention in a preferred embodiment thereof, it is apparent to those skilled in the an that the invention may be modified in arrangement and detail without depending from such principles. I therefore claim all modifications and variation coming within the spirit and scope of the following claims.

We claim:

1. A method of forming a multiplexed array of resistors comprising the steps of:

forming a plurality of address leads and ground leads arranged to define an array of nodes, each of said nodes comprising an associated address lead and an associated ground lead;

selecting nodes from said array of nodes so that any pair of address leads associated with said selected nodes are connected through respective ones of resistor heaters to not more than one common ground lead;

connecting a resistor heater to the associated address lead and the associated ground lead of each of said selected nodes, including connecting a first resistor heater to a first address lead and a first ground lead associated with a first selected node and connecting a second resistor heater to said first address lead and a second ground lead associated with a second selected node, said second ground lead having an alternate path to said first ground lead of no fewer than four series connected resistor heaters of said selected nodes other than said first selected node or said second selected node.

2. The method of claim 1 wherein the step of forming a plurality of address leads and a plurality of ground leads includes forming 45 address leads and 10 ground leads which define an array of 450 nodes; and wherein the step of connecting a resistor heater at each of said selected nodes comprises connecting resistor heaters at 90 nodes.

3. The method of claim 1 wherein the step of forming a plurality of address leads and a plurality of ground leads includes forming 27 address leads and 27 ground leads which define an array of 729 nodes; and wherein the step of connecting a resistor heater at each of said selected nodes comprises connecting resistor heaters at 108 of the nodes.

4. The method of claim 1 wherein the step of forming a plurality of address leads and a plurality of ground leads includes forming 15 address leads and 13 ground leads which define a first array of 195 nodes; and wherein the step of connecting a resistor heater at each of said selected nodes comprises connecting resistor heaters at 54 nodes of the first array.

5. The method of claim 4 wherein the step of forming a plurality of address leads and a plurality of ground leads includes forming 15 address leads and 13 ground leads which define a second array of 195 nodes; and wherein the step of connecting a resistor heater at each of said selected nodes comprises connecting resistor heaters at 54 nodes of the second array of nodes.

6. A multiplexed array of resistors comprising:

a plurality of address leads and ground leads arranged to define an array of nodes, each of said nodes comprising an associated address lead and an associated ground lead;

resistor heaters interconnecting an associated address lead and ground lead of each of a plurality of selected nodes of said array of nodes, said selected nodes selected so that any pair of address leads associated with said selected nodes are connected through respective ones of resistor heaters to not more than one common ground lead, said interconnected resistor heaters including a first resistor heater interconnected to a first associated address lead and a first associated ground lead, each of first address lead and said first ground lead associated with said first selected node and a second resistor heater interconnected to said first associated address lead and a second associated ground lead, each of said second address lead and said second ground lead associated with a second selected node, said second associated ground lead having an alternate path to said first ground lead of no fewer than four series connected resistor heaters of said selected nodes other than said first or second selected nodes.

7. An array according to claim 6 wherein the plurality of address leads and ground leads includes 45 address leads and 10 ground leads which define an array of 450 nodes, and which further comprises resistor heaters interconnecting respective address leads and ground leads at 90 of the nodes.

8. An array according to claim 6 wherein the plurality of address leads and ground leads includes 27 address leads and 27 ground leads which define an array of 729 nodes; and which includes resistor heaters interconnecting respective address leads and ground leads at 108 of the nodes.

9. An array according to claim 6 wherein the plurality of address leads and ground leads includes 15 address leads and 13 ground leads which define a first array of 195 nodes, and which includes resistor heaters interconnecting respective address leads and ground leads at 54 of the nodes.

10. An array according to claim 9 wherein the plurality of address leads and ground leads includes 15 address leads and 13 ground leads which define a second array of 195 nodes, and which includes resistor heaters interconnecting respective address leads and ground leads at 54 of the nodes.

* * * * *